US012253314B2

(12) United States Patent
Huang et al.

(10) Patent No.: US 12,253,314 B2
(45) Date of Patent: Mar. 18, 2025

(54) HEAT PIPE

(71) Applicant: DELTA ELECTRONICS, INC., Taoyuan (TW)

(72) Inventors: Shih-Lin Huang, Taoyuan (TW); Chiu-Kung Chen, Taoyuan (TW); Sheng-Hua Luo, Taoyuan (TW); Ti-Jun Wang, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 18/471,079

(22) Filed: Sep. 20, 2023

(65) Prior Publication Data

US 2024/0011719 A1 Jan. 11, 2024

Related U.S. Application Data

(63) Continuation of application No. 18/153,760, filed on Jan. 12, 2023, now Pat. No. 11,796,259, which is a continuation of application No. 17/223,696, filed on Apr. 6, 2021, now Pat. No. 11,598,585, which is a continuation of application No. 16/549,895, filed on Aug. 23, 2019, now abandoned, which is a continuation of application No. 14/818,716, filed on Aug. 5, 2015, now abandoned.

(30) Foreign Application Priority Data

Nov. 28, 2014 (CN) ..... 201410709251.7

(51) Int. Cl.
*F28D 15/02* (2006.01)
*F28D 15/04* (2006.01)

(52) U.S. Cl.
CPC ..... *F28D 15/046* (2013.01); *F28D 15/0233* (2013.01)

(58) Field of Classification Search
CPC ..... F28D 15/046; F28D 15/0233
See application file for complete search history.

(56) References Cited

U.S. PATENT DOCUMENTS

| | | | | |
|---|---|---|---|---|
| 6,695,040 | B1 | 2/2004 | Kung et al. | |
| 9,250,025 | B2 * | 2/2016 | Lee | F28D 15/046 |
| 2007/0107878 | A1 * | 5/2007 | Hou | F28D 15/046 165/104.26 |
| 2007/0131387 | A1 | 6/2007 | Kawabata et al. | |
| 2007/0246194 | A1 * | 10/2007 | Hou | F28D 15/046 165/146 |

(Continued)

*Primary Examiner* — Devon Russell
(74) *Attorney, Agent, or Firm* — MUNCY, GEISSLER, OLDS & LOWE, P.C.

(57) ABSTRACT

A heat pipe comprises a flat tube and a wick structure. The flat tube includes a hollow chamber and has a front and a rear sealed ends along an axial direction. The wick structure is disposed in the hollow chamber and extended along the axial direction of the flat tube. The wick structure is divided into a front, a middle and a rear sections sequentially along the axial direction. The front section is near the front sealed end, the rear section is near the rear sealed end. The front, middle and rear sections have a maximum length parallel to the width direction, respectively. The maximum length of the front section is greater than that of the middle section, and the maximum length of the middle section is greater than that of the rear section.

9 Claims, 15 Drawing Sheets

(56) References Cited

U.S. PATENT DOCUMENTS

| | | | | |
|---|---|---|---|---|
| 2007/0251673 | A1* | 11/2007 | Hou | F28D 15/046 165/146 |
| 2007/0295485 | A1* | 12/2007 | Liu | F28D 15/046 165/104.33 |
| 2009/0139696 | A1* | 6/2009 | Shih | F28F 1/022 165/104.26 |
| 2009/0166003 | A1 | 7/2009 | Lai et al. | |
| 2009/0166008 | A1 | 7/2009 | Lai et al. | |
| 2009/0219695 | A1* | 9/2009 | Tomioka | G06F 1/203 165/104.26 |
| 2010/0266864 | A1 | 10/2010 | Lee | |
| 2012/0031588 | A1 | 2/2012 | Huang et al. | |
| 2012/0111539 | A1 | 5/2012 | Dai et al. | |
| 2012/0279687 | A1* | 11/2012 | Meyer, IV | F28D 15/046 165/104.26 |
| 2013/0213609 | A1 | 8/2013 | Wu | |
| 2013/0213610 | A1 | 8/2013 | Wu | |
| 2013/0213612 | A1* | 8/2013 | Wu | F28D 15/046 165/104.26 |
| 2013/0233520 | A1 | 9/2013 | Lo et al. | |
| 2014/0166245 | A1 | 6/2014 | Dai et al. | |
| 2014/0290914 | A1 | 10/2014 | Chiou et al. | |
| 2015/0114603 | A1* | 4/2015 | Pai | H05K 7/20336 165/104.26 |
| 2015/0114604 | A1* | 4/2015 | Pai | F28D 15/046 165/104.26 |
| 2015/0198376 | A1* | 7/2015 | Pai | F28D 15/0233 165/104.26 |

* cited by examiner

HEAT PIPE

CROSS REFERENCE TO RELATED APPLICATIONS

This application is a Continuation application (CA) of U.S. Ser. No. 18/153,760 and filed on Jan. 12, 2023, which is a Continuation application (CA) of U.S. Ser. No. 17/223,696 and filed on Apr. 6, 2021, which is a Continuation application (CA) of U.S. Ser. No. 16/549,895 and filed on Aug. 23, 2019, which is a Continuation application (CA) of U.S. Ser. No. 14/818,716 and filed on Aug. 5, 2015, which claims priority under 35 U.S.C. § 119(a) on Patent Application No(s). 201410709251.7 and filed in People's Republic of China on Nov. 28, 2014, the entire contents of which, including drawings, is expressly incorporated by reference herein.

BACKGROUND OF THE INVENTION

Field of Invention

The invention relates to a heat pipe and, in particular, to a heat pipe with better performance.

Related Art

A conventional heat pipe is mainly composed of a sealed metal pipe, a wick core structure inside the metal pipe and a heat-transfer fluid filled in the metal pipe, and besides, a proper vacuum degree is kept inside the metal pipe to lower down the trigger-temperature-difference of the heat pipe. In the heat pipe, the evaporator of the heat pipe is disposed at the heat source so that the heat generated by the heat source can evaporate the fluid (liquid phase) in the pipe into the vapor (vapor phase). The generated vapor is driven by the vapor pressure difference to flow to the condenser of the heat pipe and then condenses back to the liquid phase after releasing the latent heat, and lastly is driven by the capillarity to go back to the evaporator through the wick core structure. Thereby, the heat pipe can transfer the heat to the outside rapidly.

Due to its simple structure, high transfer performance and low thermal resistance, the heat pipe has been applied to the electronic field or other heat-dissipation fields for a long time. However, because the electronic product is continuously enhanced in portability, lightness and thinness, 4K image, 4G transmission and more adding functions, the generated heat thereof is raised increasingly. Therefore, the conventional heat pipe can't meet the requirement of the high heat and high heat flux anymore. Accordingly, the heat pipe needs to be further enhanced in performance, for example, the manufacturing method of the wick core needs to be improved so as to enhance the capillarity of the wick structure.

The conventional wick core structure of the heat pipe is made by disposing a core rod in the metal pipe to fix the metal powder and also formed by the high sintering, so that the metal powder can be attached to the whole or partial inner wall of the metal pipe. However, the core rod has a high cost and may be damaged during the process of the sintering or removing the core rod, and even the wick structure will also be damaged. Therefore, the performance of the heat pipe will be reduced.

Furthermore, the factors of the influence of the wick core on the heat pipe performance mainly include: the thickness of the sintering layer, porosity, permeability and powder diameter. The above factors will affect the heat pipe during the water injection process or the vacuum process and further affect the performance of the heat pipe. In the heat pipe design, the thickness of the sintering layer and the powder diameter can be determined by the conventional method, but the porosity and permeability only can be estimated by experience. If the data of the porosity and permeability need to be obtained, they can be measured just after the sintering process. In other words, the yield of the wick core structure is still hard to be controlled accurately.

Although the wick core structure formed by the sintering has been gradually replaced by the wick structure formed by the groove, mesh or fine fiber in the current manufacturing of the thin-type heat pipe, the capillarity of the wick structure formed by the sintering is far greater than that of the wick structure formed by the groove, in consideration of the heat transfer capability. Besides, the heat resistance generated by the sintered-type heat pipe is relatively lower. In other words, although the sintered-type heat pipe has the insuperable problem, it still has the space of development, in consideration of its advantage of the heat transfer capability.

The wick core structure of a conventional heat pipe is approximately formed as shown in FIGS. 1A and 1B, wherein FIG. 1A is a schematic diagram of a part of the appearance of a conventional heat pipe and FIG. 1B is a schematic sectional diagram of the heat pipe in FIG. 1A in the radial direction. The heat pipe H includes a pipe 1 and a wick structure 2. The pipe 1 has an elliptic section and includes a hollow chamber 10, and the wick structure 2 is disposed in the hollow chamber 10 and extended along the axial direction D1 of the pipe 1. Otherwise, as shown in FIGS. 2A to 2H, the pipes 1*a*, 1*b*, 1*c*, 1*d* of the heat pipes H1, H2, H3, H4 all have rectangular sections, and besides, for the heat pipes H1, H1, H2, H3, H4, each of the sections of the wick structures 2, 2*a*, 2*b*, 2*c*, 2*d* in the redial direction D2 of the pipes 1, 1*a*, 1*b*, 1*c*, 1*d* has a uniform shape and area between the two ends of each of the pipes 1, 1*a*, 1*b*, 1*c*, 1*d*. However, in the practical applications, the above-mentioned heat pipe form is hard to meet the heat-dissipation requirements of different electronic devices, and also the desired heat-dissipation effect can't be obtained.

Therefore, it is an important subject to provide a heat pipe where the wick structure can be disposed according to the performance requirement and the porosity and permeability of the wick structure can be effectively controlled, so as to enhance the yield and heat transfer performance of the heat pipe.

SUMMARY OF THE INVENTION

In view of the foregoing subject, an objective of the invention is to provide a heat pipe where the wick structure can be disposed according to the performance requirement and the porosity and permeability of the wick structure can be effectively controlled, so as to enhance the yield and heat transfer performance of the heat pipe.

To achieve the above objective, a heat pipe according to the invention comprises a pipe and at least a wick structure. The pipe includes a hollow chamber. The wick structure is disposed in the hollow chamber and extended along an axial direction of the pipe. A section of the wick structure along the axial direction is not a uniform section between two ends of the pipe.

In one embodiment, the pipe is a cylindrical pipe, an elliptic pipe or a rectangular pipe.

In one embodiment, the wick structure is formed outside the pipe.

In one embodiment, the section of the wick structure along the axial direction of the pipe has a continuous edge.

In one embodiment, the section of the wick structure along the axial direction of the pipe has a discontinuous edge.

In one embodiment, the heat pipe further comprises a plurality of wick structures which are disposed adjacent to each other in the pipe.

In one embodiment, each of the wick structures includes at least a support portion pressing an inner wall of the pipe.

To achieve the above objective, a heat pipe according to the invention comprises a pipe and at least a wick structure. The pipe includes a hollow chamber. The wick structure is disposed in the hollow chamber and extended along an axial direction of the pipe. A section of the wick structure along a radial direction of the pipe is not a uniform section.

To achieve the above objective, a heat pipe according to the invention comprises a pipe and at least a wick structure. The pipe includes a hollow chamber. The wick structure is disposed in the hollow chamber and extended along an axial direction of the pipe. A section of the wick structure along the axial direction is not a uniform section between two ends of the pipe. A section of the wick structure along a radial direction of the pipe is not a uniform section.

Summarily, the wick structure of the heat pipe of this invention can be varied in form along the axial direction of the pipe so as to meet the structure requirement of the evaporator, heat insulator and condenser of the heat pipe and can be adjusted according to the space and performance of the pipe of the heat pipe or according to the actual heat-dissipation requirement.

The conventional wick core structure of the heat pipe is made by disposing a core rod in the metal pipe to fix the metal powder and also formed by the high sintering, but the core rod has a high cost and may be damaged during the process of the sintering or removing the core rod, and even the wick structure may be also damaged, so that the performance of the heat pipe is reduced. However, the wick structure of this embodiment is formed on the outside firstly, and the form of the wick structure can be designed according to the performance requirement and won't be limited by the core rod required for the conventional process. Besides, favorably, the quality of the wick structure can be examined outside the pipe firstly to eliminate the defective products in advance so as to enhance the yield of the heat pipe.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
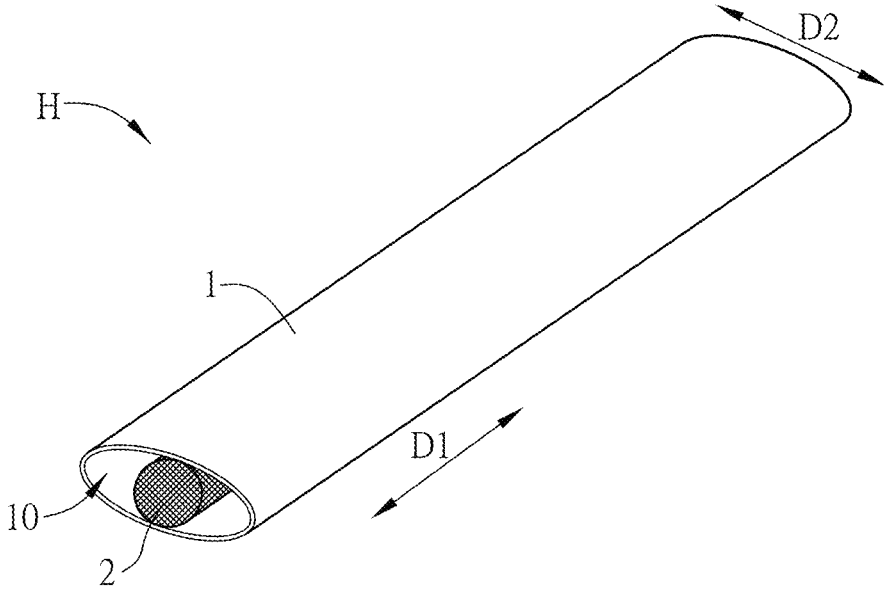
FIG. 1A is a schematic diagram of a part of the appearance of a conventional heat pipe.
Figure 1B:
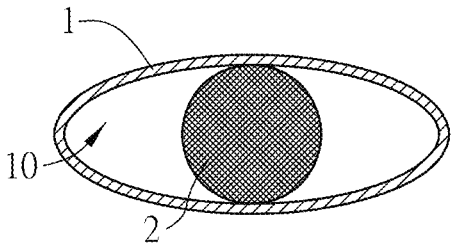
FIG. 1B is a schematic sectional diagram of the heat pipe in FIG. 1A in the radial direction.
Figure 2A:
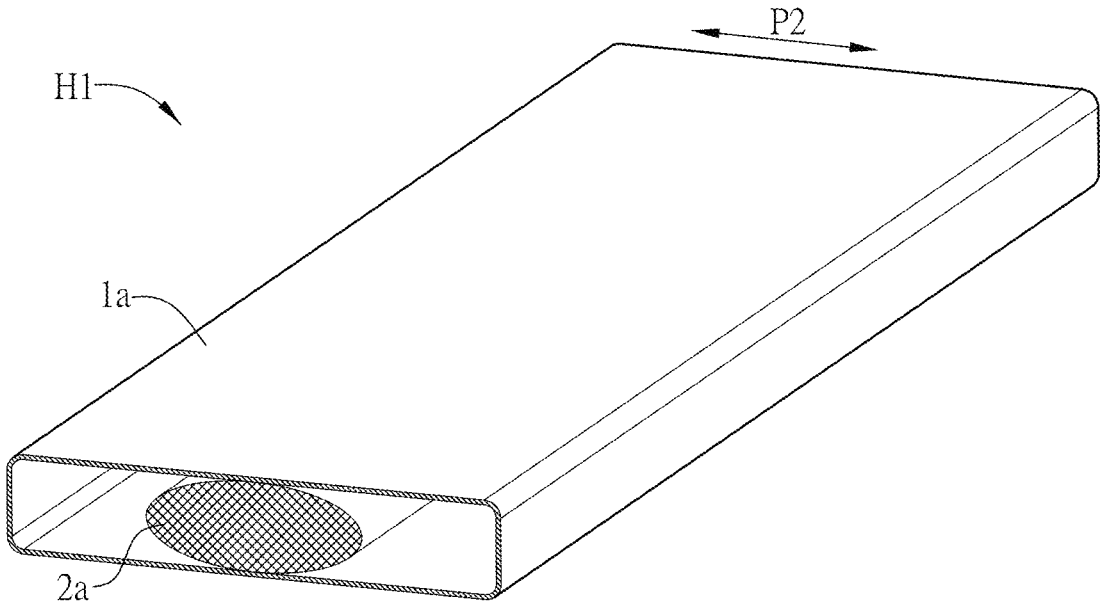
FIGS. 2A, 2C, 2E, 2G are schematic diagrams of a part of the appearances of different conventional heat pipes.
Figure 2B:
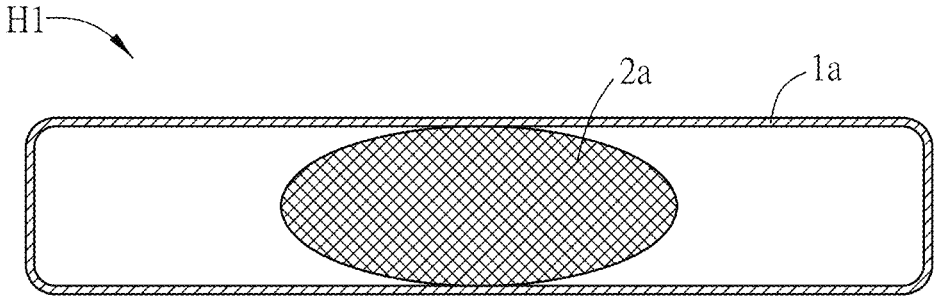
FIGS. 2B, 2D, 2F, 2H are schematic sectional diagram of the heat pipes in FIGS. 2A, 2C, 2E, 2G in the radial direction.
Figure 2C:
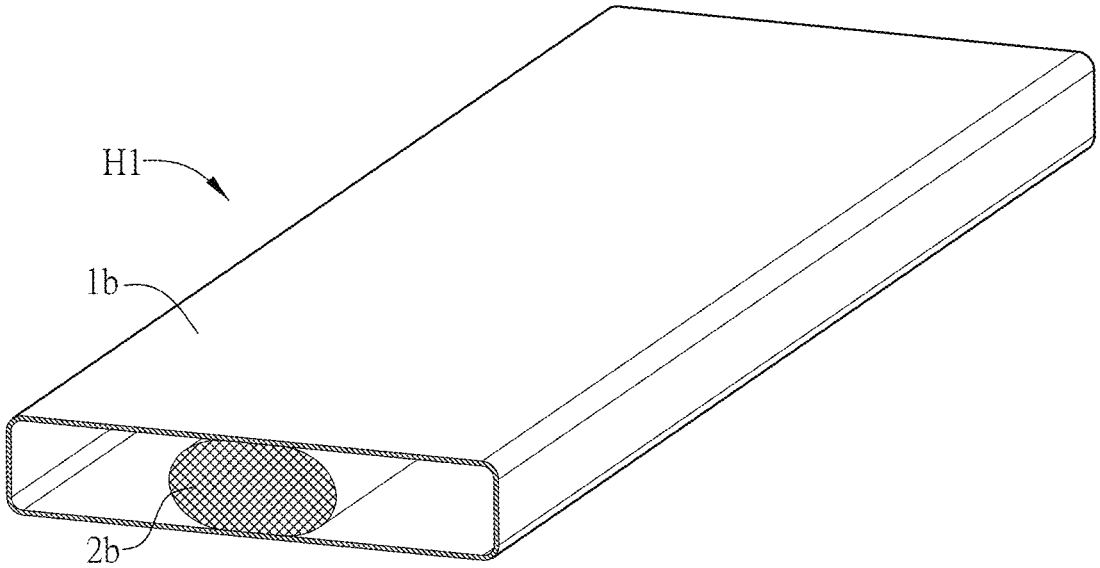
Figure 2D:
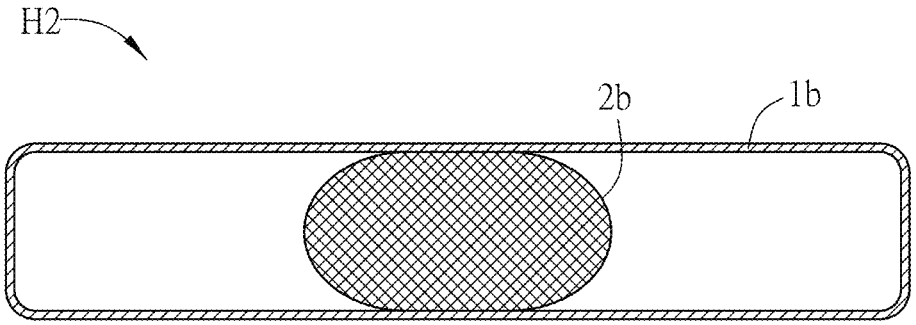
Figure 2E:
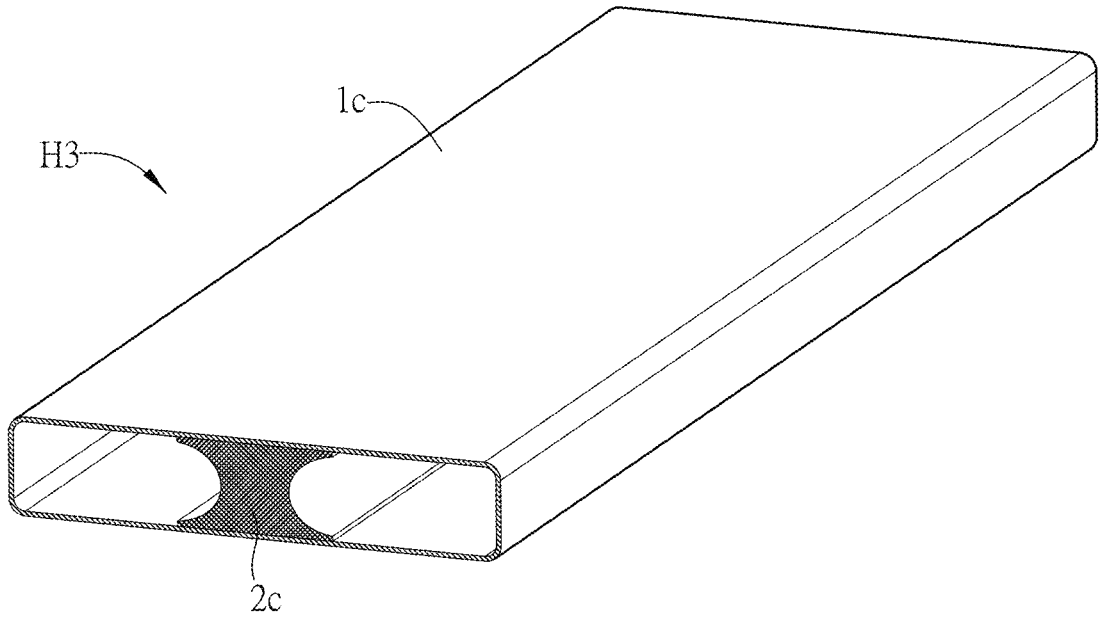
Figure 2F:
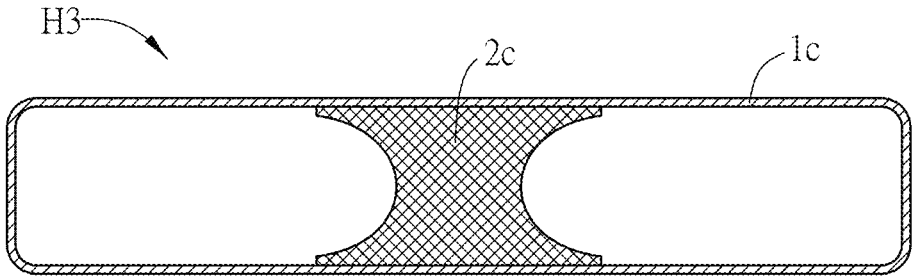
Figure 2G:
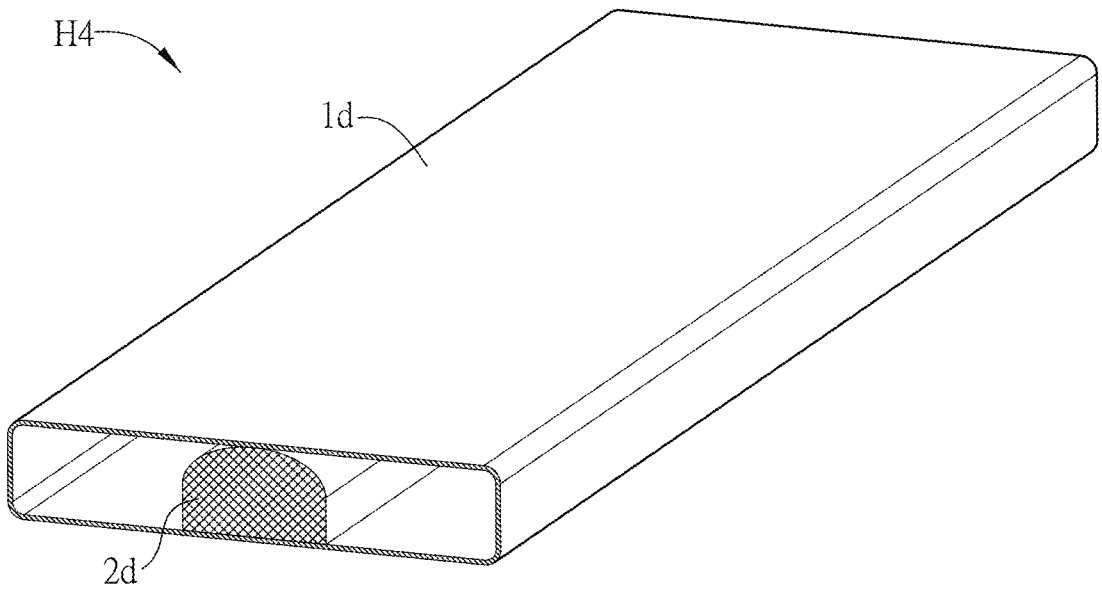
Figure 2H:
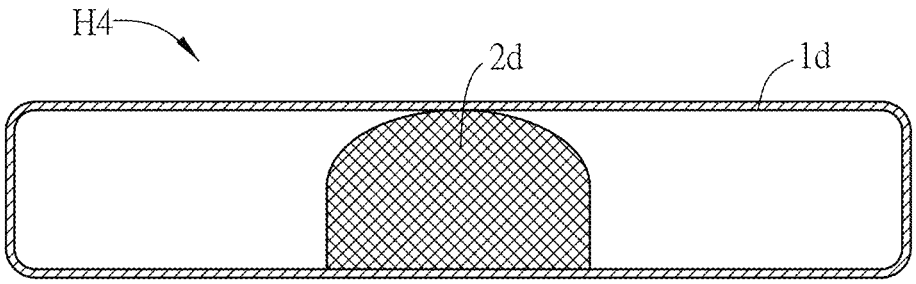
Figure 3A:
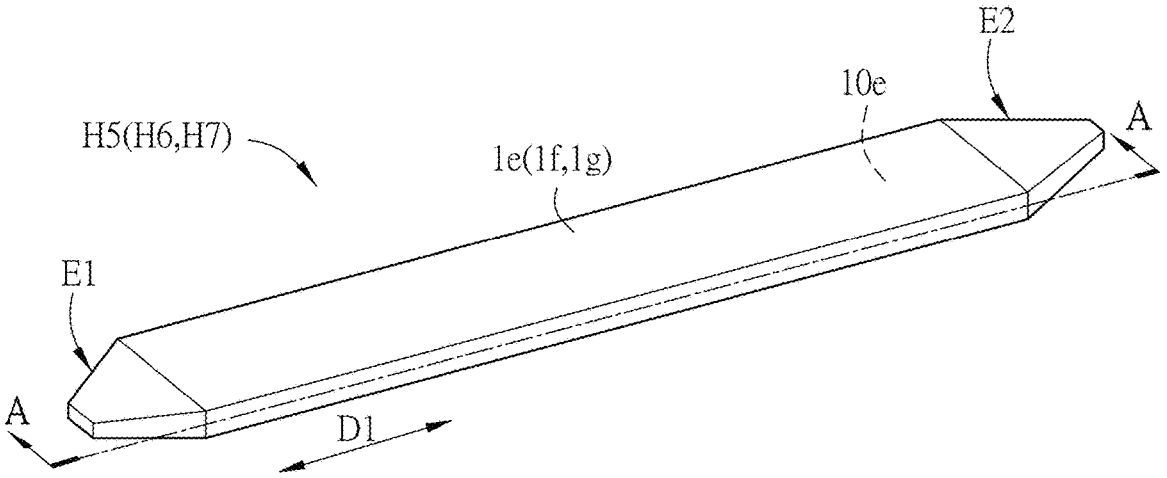
FIG. 3A is a schematic diagram of the appearance of the heat pipe of an embodiment of the invention.
Figure 3B:
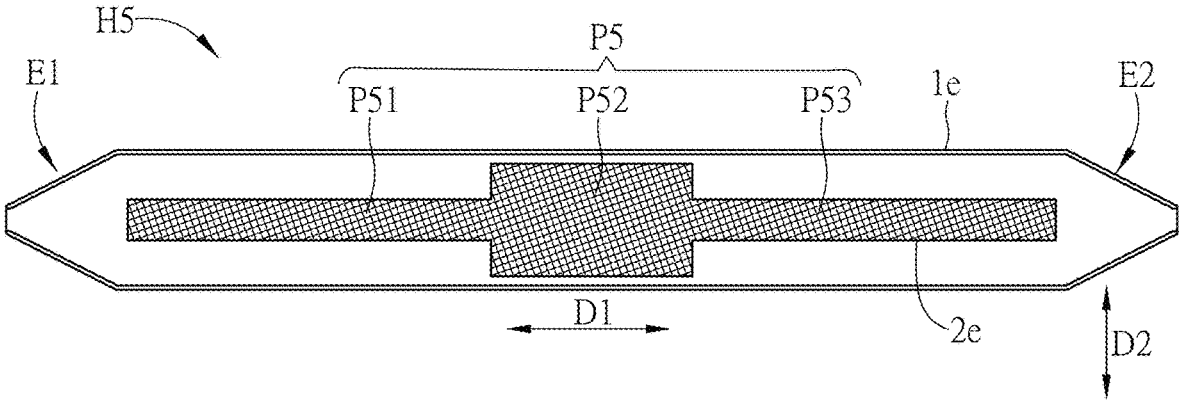
FIG. 3B is a schematic sectional diagram of the heat pipe taken along the line A-A in FIG. 3A.

FIG. 3A is a schematic diagram of the appearance of the heat pipe of an embodiment of the invention, and FIG. 3B is a schematic sectional diagram of the heat pipe taken along the line A-A in FIG. 3A. As shown in FIGS. 3A and 3B, in this embodiment, the heat pipe H5 includes a pipe 1*e* and at least a wick structure 2*e*. A single wick structure 2*e* is illustrated as an example herein. The pipe 1*e* has a hollow chamber 10*e*, and the wick structure 2*e* is disposed in the hollow chamber 10*e* and extended along the axial direction D1 of the pipe 1*e*. The pipe 1*e* is a flat and cylindrical thin-type hollow tube. The pipe 1*e* can be made by, for example, copper, silver, aluminum, their alloy or other metal materials with well heat transfer property. In the practical application, in addition to the wick structure 2*e*, a working fluid (not shown) is also disposed in the pipe 1*e* and can be any fluid helping the evaporation and heat dissipation, such as inorganic compounds, alcohols, ketones, liquid metal, refrigerant, organic compounds or their any mixture. Moreover, the pipe 1*e* is not limited here in shape or dimensions, which can be a cylindrical tube or rectangular tube and can be determined according to the surrounding environment, space, heat transfer requirement or temperature.

As shown in FIGS. 3A and 3B, the wick structure 2*e* of this embodiment is formed outside the pipe 1*e*. In detail, the wick structure 2*e* is formed outside the pipe 1*e* first, and can be formed by the high sintering and/or injection molding, but this invention is not limited thereto. Besides, before the wick structure 2*e* is disposed to the pipe 1*e*, the porosity and permeability thereof are properly controlled by the forming method so as to enhance the capillarity of the wick structure, and therefore the amount of the working fluid flowing back to the evaporator can be increased and the maximum heat transfer amount (Qmax) of the heat pipe can be effectively increased.

The conventional wick core structure of the heat pipe is made by disposing a core rod in the metal pipe to fix the metal powder and also formed by the high sintering, but the core rod has a high cost and may be damaged during the process of the sintering or removing the core rod, and even the wick structure may be also damaged, so that the performance of the heat pipe is reduced. However, the wick structure 2*e* of this embodiment is formed on the outside firstly, and the form of the wick structure can be designed according to the performance requirement and won't be limited by the core rod required for the conventional process. Besides, favorably, the quality of the wick structure 2*e* can be examined outside the pipe 1*e* firstly to eliminate the defective products in advance so as to enhance the yield of the heat pipe H5.

As shown in FIGS. 3A and 3B, in this embodiment, the section P5 of the wick structure 2*e* along the axial direction D1 of the pipe 1*e* has a discontinuous edge and is not a uniform section between the two ends E1, E2 of the pipe 1*e*. In other words, the section P5 can be divided into the sections P51, P52, P53 from one end E1 of the pipe 1*e* to the other end E2, and the section P52 is located between the sections P51 and P53. Besides, the section P52 has a greater area than the sections P51 and P53. In other words, the middle region of the heat pipe H5 can be used as the evaporator of the heat pipe, and in practice, this middle region can be attached to the heat source so as to achieve a better heat-dissipation effect.

Figure 3C:
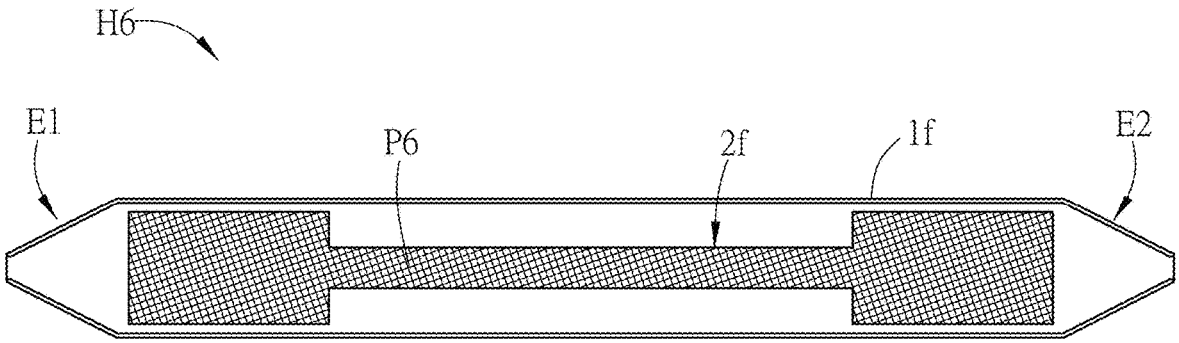
FIGS. 3C and 3D are schematic sectional diagrams taken along the line A-A of the heat pipe of FIG. 3A according to different embodiments of the invention.
Figure 3D:
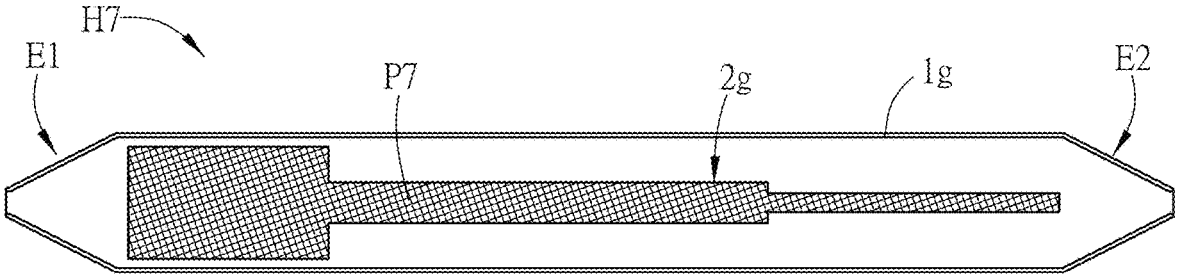

In addition to the above-mentioned structure, the discontinuous edge of the section of the wick structure along the axial direction also can be applied to the cases of FIGS. 3C and 3D, which are schematic sectional diagrams taken along the line A-A of the heat pipe of FIG. 3A according to different embodiments of the invention. The appearance in FIG. 3A with the line A-A is just for showing the position of the sections in FIGS. 3C and 3D, and FIGS. 3C and 3D actually show the heat pipe structures of different embodiments. As shown in FIGS. 3A, 3C, 3D, particularly, the structures of the heat pipes H6, H7 are substantially the same as the heat pipe H5 of the above embodiment, wherein each of the sections P6, P7 of the wick structures 2*f*, 2*g* of the heat pipes H6, H7 along the axial direction D1 of the pipes 1*f*, 1*g* is not a uniform section between the two ends of each of the pipes 1*f*, 1*g*, and besides, the sections of the wick structures 2*f*, 2*g* along the axial direction of the pipes both have a discontinuous edge. However, the section P6 of the heat pipe H6 has a less area at the middle region between the two ends E1, E2 of the pipe 1*f* but has a greater area at the ends E1, E2; and the section P7 of the heat pipe H7 has a greater area at the end E1 of the pipe 1*g* but has a less area at the end E2. In practice, the region of the section with a greater area can be attached to the heat source so as to achieve a better heat-dissipation effect.

Figure 4A:
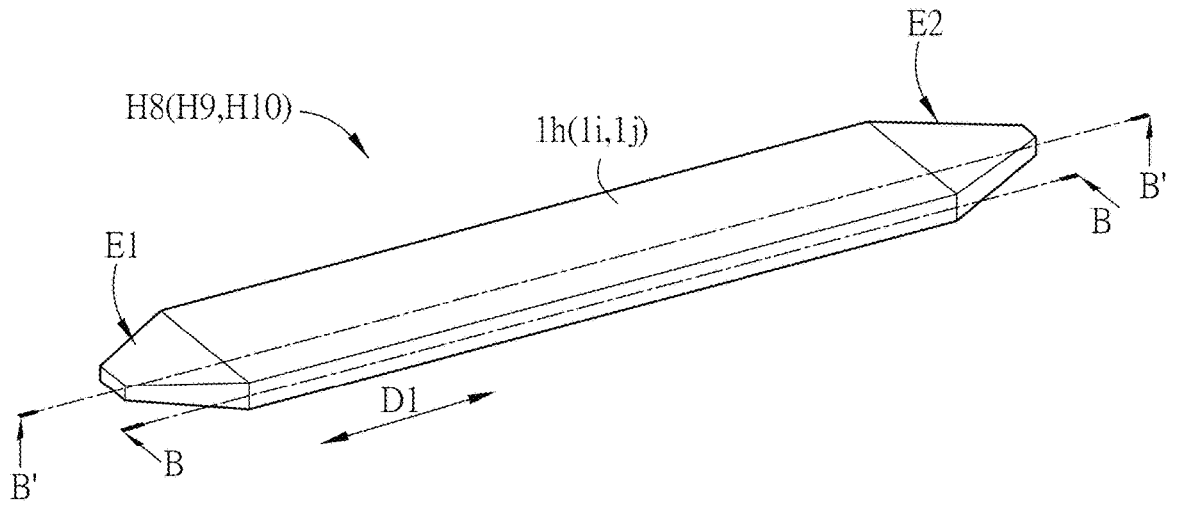
FIG. 4A is a schematic diagram of the appearance of the heat pipe of another embodiment of the invention.
Figure 4B:
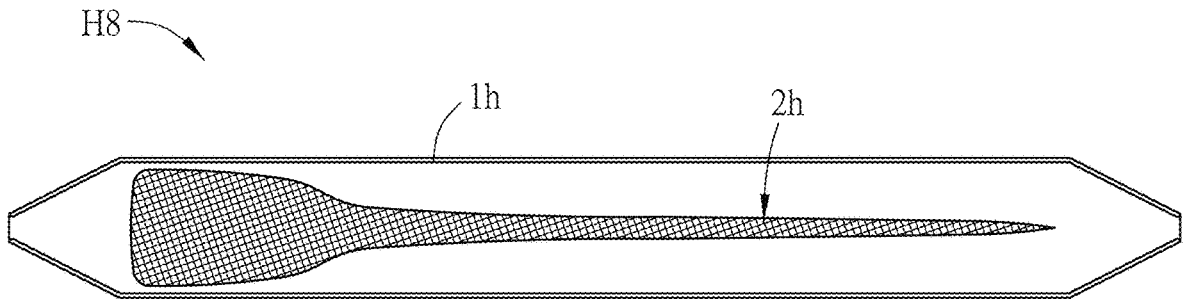
FIGS. 4B, 4C, 4D are schematic sectional diagrams of the heat pipe in FIG. 4A taken along the line B-B according to different embodiments.
Figure 4C:
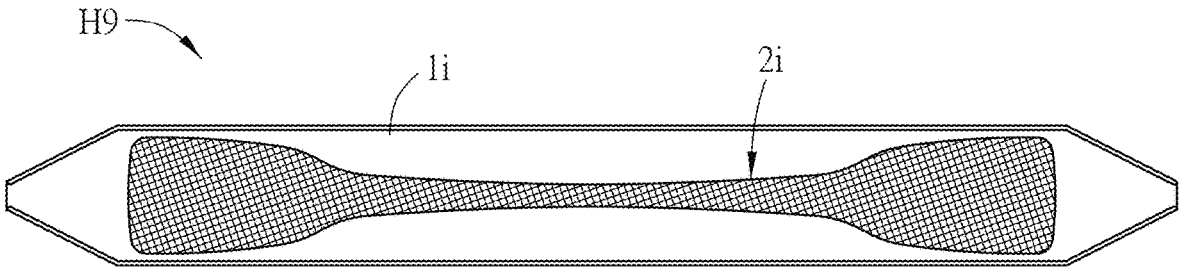
Figure 4D:
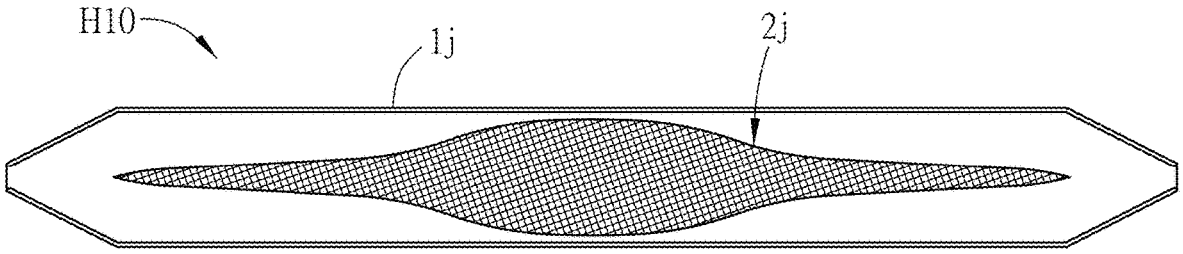

The form of the edge of the section of the wick structure of the above-mentioned heat pipes H5, H6, H7 is not meant to be construed in a limiting sense. FIG. 4A is a schematic diagram of the appearance of the heat pipe of another embodiment of the invention, and FIGS. 4B, 4C, 4D are schematic sectional diagrams of the heat pipe in FIG. 4A taken along the line B-B according to different embodiments. As shown in FIGS. 4A to 4D, in the heat pipes H8, H9, H10, the sections of the wick structures 2*h*, 2*i*, 2*j* along the axial directions of the pipes 1*h*, 1*i*, 1*j* all have a continuous edge. In other words, the edge of each of the sections of the wick structures 2*h*, 2*i*, 2*j* has a smooth form without the sectional difference. In comparison with the above embodiments, since the heat pipes H8, H9, H10 of this embodiment have the continuous edges, the less flow resistance can be generated and the maximum thermal design power of the heat pipes H8, H9, H10 can be thus enhanced.

Figure 4E:
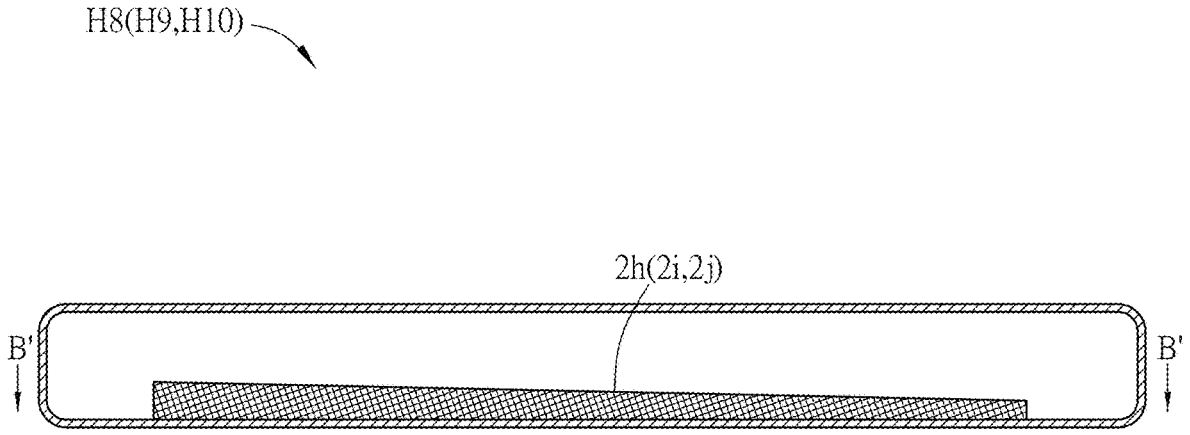
FIG. 4E is a schematic sectional diagram of the heat pipe in FIG. 4A taken along the line B'-B'.

Besides, the thickness variation along the axial direction of the heat pipes H8, H9, H10 is shown as FIG. 4E, which is a schematic sectional diagram of the heat pipe in FIG. 4A taken along the line B'-B'. The wick structures 2*h*, 2*i*, 2*j* of the heat pipes H8, H9, H10 have the thickness variation along the axial direction, but this thickness variation is not meant to be construed in a limiting sense and can be adjusted according to the change of the heat source position.

Figure 5A:
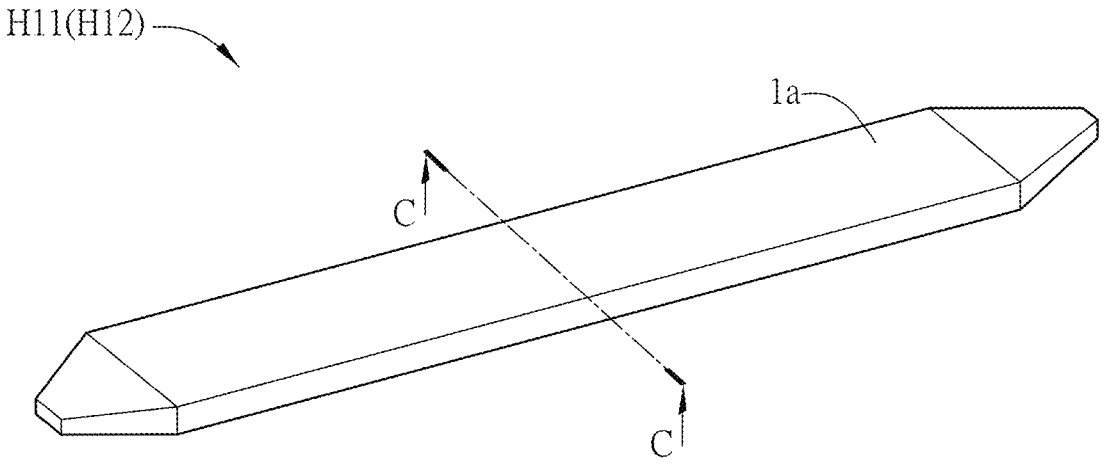
FIG. 5A is a schematic diagram of the appearance of the heat pipe of another embodiment of the invention.
Figure 5B:
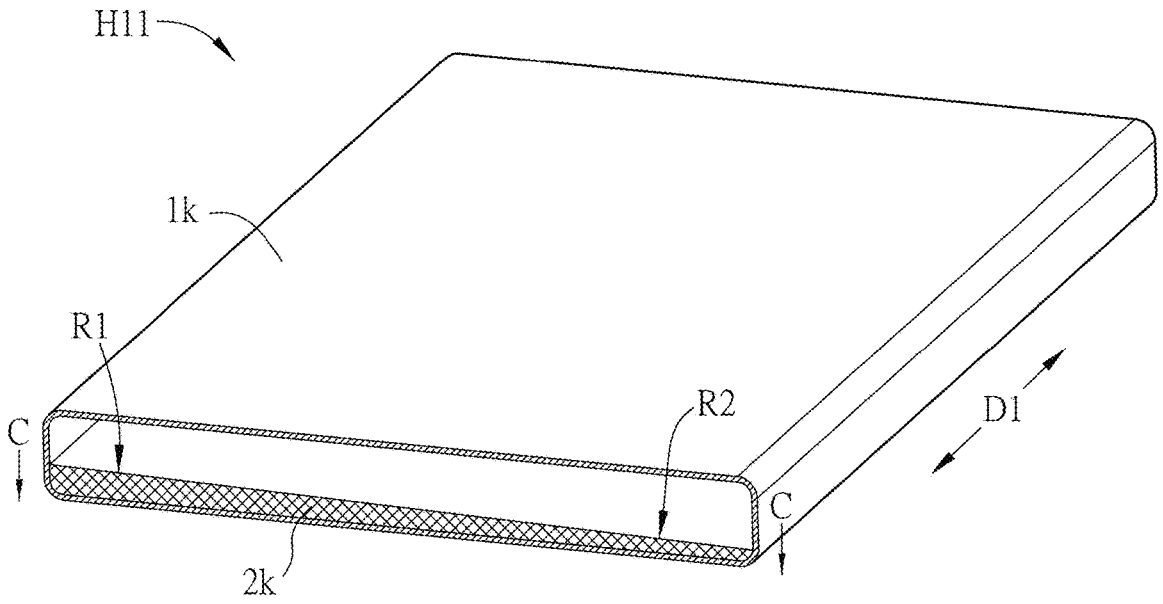
FIGS. 5B and 5D are schematic perspective sectional diagrams of the heat pipe in FIG. 5A taken along the line C-C according to different embodiments.
Figure 5C:
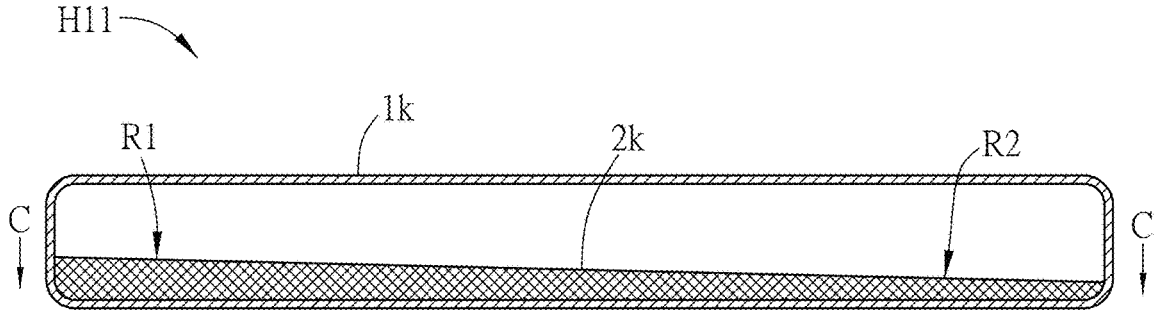
FIGS. 5C and 5E are schematic sectional diagrams of the heat pipes of FIGS. 5B and 5D respectively.
Figure 5D:
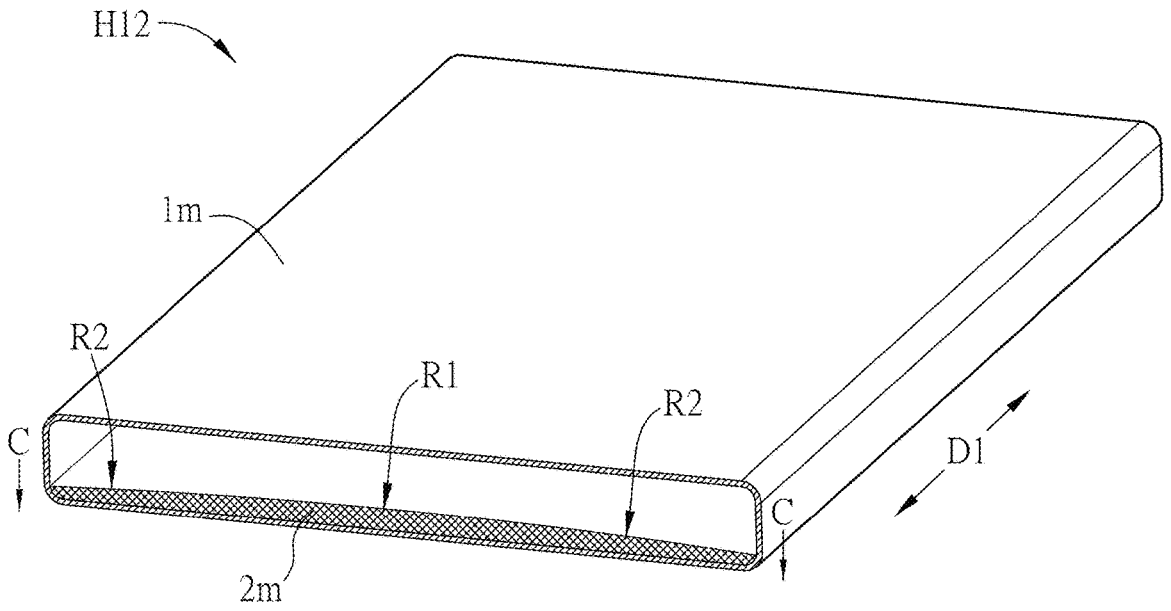
Figure 5E:
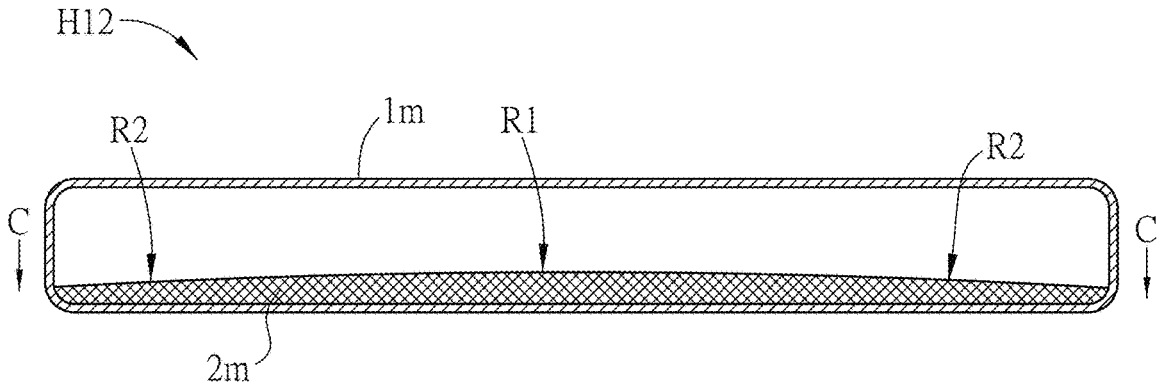

In addition to the above embodiments, this invention further includes the wick structures of other types. FIG. 5A is a schematic diagram of the appearance of the heat pipe of another embodiment of the invention, FIGS. 5B and 5D are schematic perspective sectional diagrams of the heat pipe in FIG. 5A taken along the line C-C according to different embodiments, and FIGS. 5C and 5E are schematic sectional diagrams of the heat pipes of FIGS. 5B and 5D respectively. The appearance in FIG. 5A with the line C-C is just for showing the position of the sections in FIGS. 5B and 5D, and FIGS. 5B and 5D actually show the heat pipe structures of different embodiments. Particularly, like the heat pipe H5 of the above embodiment, each of the sections of the wick structures 2*k*, 2*m* of the heat pipes H11, H12 along the axial direction D1 of the pipes 1*k*, 1*m* is not a uniform section between the two ends of each of the pipes 1*k*, 1*m*. In detail, the wick structures 2*k*, 2*m* both have a varied thickness in the view of the heat pipes H11, H12 along the radial direction. The thicker region (such as the region R1) can be used to be attached to the portion of the heat source T having a higher temperature, and the thinner region (such as the region R2) can be used to be attached to the portion of the heat source T having a lower temperature. In other words, the wick structures 2*k*, 2*m* of the heat pipes H11, H12 of this embodiment both have the thickness variation along the redial direction. However, the distribution and variation of the thickness of the wick structure is not meant to be construed in a limiting sense, and the wick structures 2*k*, 2*m* can be adjusted according to the space and performance of the pipes 1*k*, 1*m* or the heat-dissipation requirement. The related application will be illustrated hereinafter.

In other embodiments, the embodiments of the heat pipes H8, H9, H10 also can be combined with the embodiments of the heat pipes H11, H12. For example, the wick structure of the heat pipe can be adjusted in both of the axial and radial directions so as to meet the actual heat-dissipation requirement, but this invention is not limited thereto.

Figure 6A:
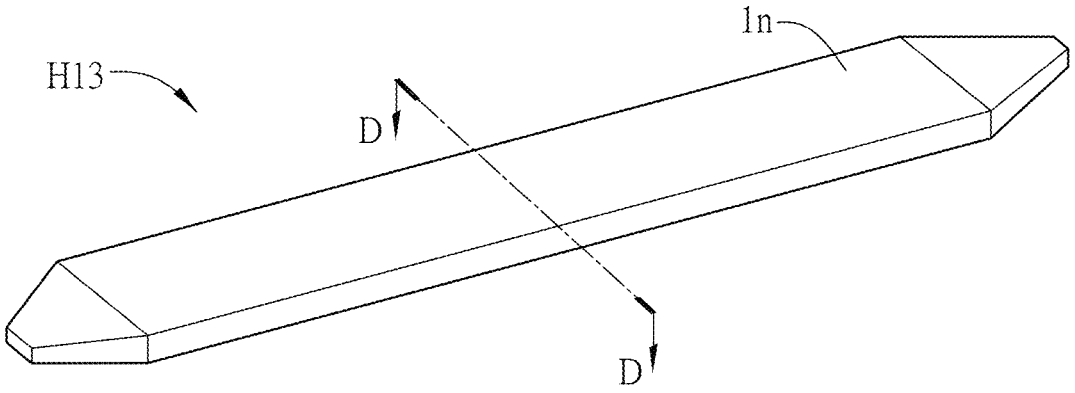
FIG. 6A is a schematic diagram of a part of the appearance of the heat pipe of an embodiment of the invention.
Figure 6B:
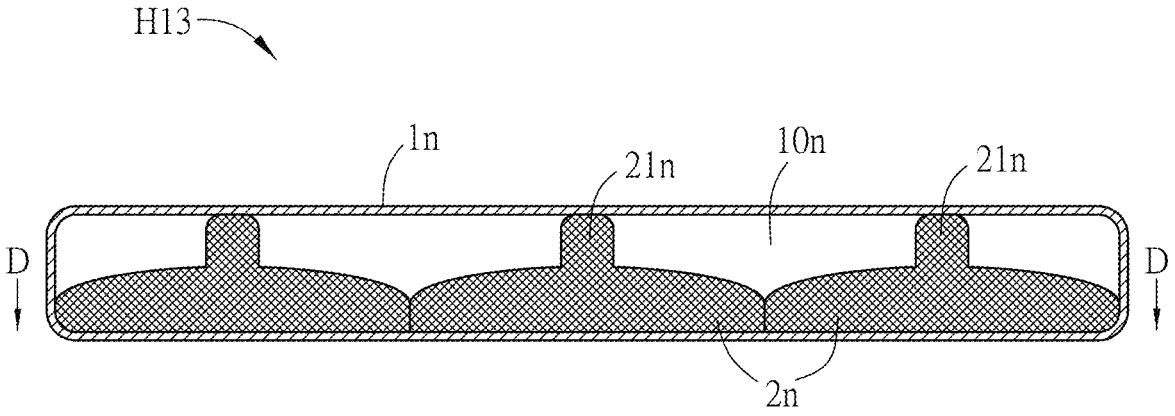
FIG. 6B is a schematic sectional diagram of the heat pipe in FIG. 6A taken along the line D-D.

FIG. 6A is a schematic diagram of a part of the appearance of the heat pipe of an embodiment of the invention, and FIG. 6B is a schematic sectional diagram of the heat pipe in FIG. 6A taken along the line D-D. As shown in FIGS. 6A and 6B, in comparison with the above embodiments, the heat pipe H13 includes a larger pipe 1*n*. In other words, the pipe 1*n* includes a larger hollow chamber 10*n*. The heat pipe H13 includes a plurality of wick structures 2*n* disposed adjacent to each other in the pipe 1*n*. Through the disposition of a plurality of wick structures 2*n*, a flat heat pipe H13 with a larger area can be formed. Besides, the wick structure 2*n* of this embodiment further includes at least a support portion 21*n* (herein for example, each of the wick structures 2*n* includes a support portion 21*n*), and the support portion 21*n* has the same material as the wick structure 2*n*. The support portion 21*n* presses the inner wall of the pipe 1*n* to act as a support structure so as to prevent the depression and deformation of the heat pipe H13.

Figure 7:
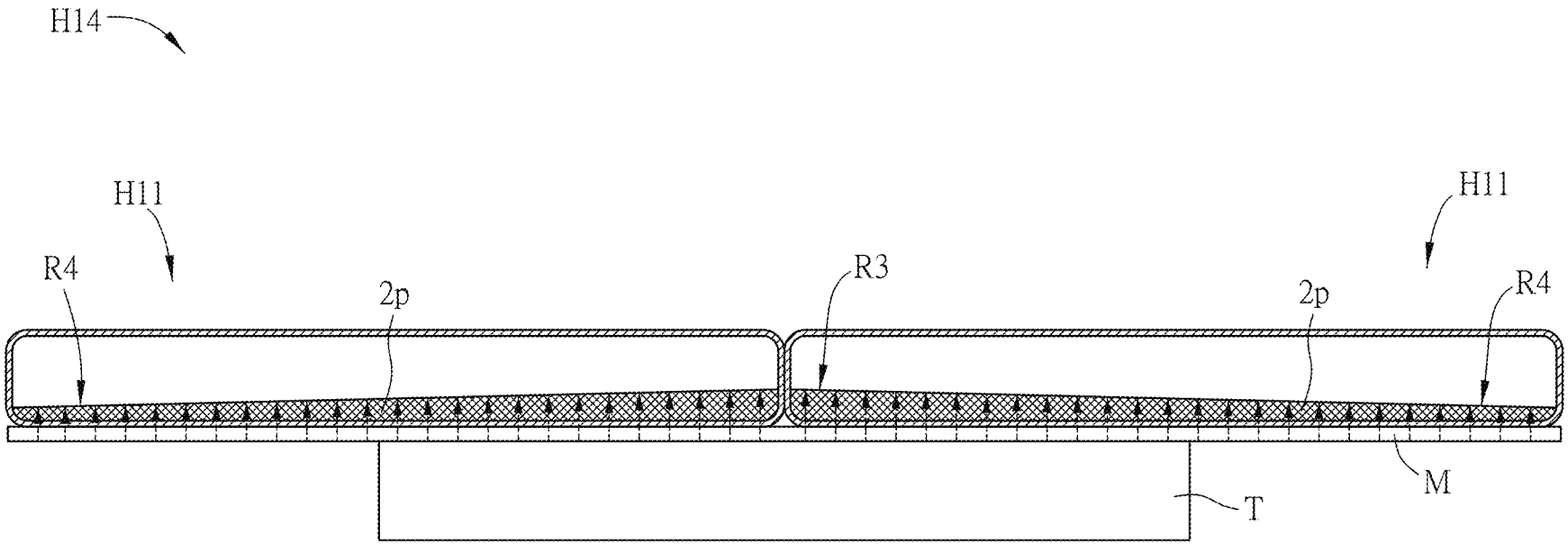
FIG. 7 is a schematic sectional diagram of the heat pipe of another embodiment of the invention.

In practice, the above different heat pipe structures can be combined together to enhance the applicability of the heat pipe. As shown in FIG. 7 where two heat pipes H11 disposed side by side to form the heat pipe H14 for the illustrative purpose, when the heat pipe H14 is viewed in the radial direction, the wick structure 2*p* has a varied thickness. The thicker region (such as the region R3) can act as the evaporator of the heat pipe H14 and the thinner region (such as the region R4) can act as the condenser of the heat pipe H14. In detail, the region R3 of the heat pipe H14 can be disposed closer to the heat source T and the region R4 can be disposed away from the heat source T. Since the thicker region of the wick structure 2*p* has stronger capillarity, the working fluid will be provided with a better capability of flowing back and the thicker region can bear larger heat flux and temporary heat impact, and therefore the heat pipe H14 can operate stably to avoid the idle heating condition. In practice, a thin metal plate M (such as a copper plate) can be disposed on the heat source T so as to evenly disperse the heat of the heat source T and make an evener heating surface.

Summarily, the wick structure of the heat pipe of this invention can be varied in form along the axial direction of the pipe so as to meet the structure requirement of the evaporator, heat insulator and condenser of the heat pipe and can be adjusted according to the space and performance of the pipe of the heat pipe or according to the actual heat-dissipation requirement.

The conventional wick core structure of the heat pipe is made by disposing a core rod in the metal pipe to fix the metal powder and also formed by the high sintering, but the core rod has a high cost and may be damaged during the process of the sintering or removing the core rod, and even the wick structure may be also damaged, so that the performance of the heat pipe is reduced. However, the wick structure of this embodiment is formed on the outside firstly, and the form of the wick structure can be designed according to the performance requirement and won't be limited by the core rod required for the conventional process. Besides, favorably, the quality of the wick structure can be examined outside the pipe firstly to eliminate the defective products in advance so as to enhance the yield of the heat pipe.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A heat pipe, comprising:

a flat tube having an axial direction, a width direction and a height direction perpendicular to each other, the length in the width direction is greater than that in the height direction, wherein the flat tube includes a hollow chamber and has a front sealed end and a rear sealed end along the axial direction; and a wick structure disposed in the hollow chamber and extended along the axial direction of the flat tube, wherein the wick structure is divided into a front section, a middle section and a rear section sequentially along the axial direction, the front section is near the front sealed end, the rear section is near the rear sealed end, wherein the front, middle and rear sections have a maximum length parallel to the width direction, respectively; and the maximum length of the front section is greater than that of the middle section, and the maximum length of the middle section is greater than that of the rear section, wherein the wick structure is completely disconnected from two opposite sidewalls of the flat tube, wherein a cross-sectional area of the front section measured along the axial direction and the width direction is larger than that of the middle section measured along the axial direction and the width direction, a cross-sectional area of the middle section measured along the axial direction and the width direction is larger than that of the rear section measured along the axial direction and the width direction, and wherein the connection between the front section and the middle section exhibits a sectional difference, the connection between the middle section and the rear section exhibits a sectional difference.

2. The heat pipe as recited in claim 1, wherein the length in the axial direction is greater than that in the height direction.

3. The heat pipe as recited in claim 1, wherein the length in the axial direction is greater than that in the width direction.

4. The heat pipe as recited in claim 1, wherein the two opposite sidewalls are perpendicular to the width direction, respectively.

5. The heat pipe as recited in claim 1, wherein the flat tube is rectangular.

6. The heat pipe as recited in claim 5, wherein the cross-sections of the front section, the middle section and the rear section in the axial direction are rectangles, respectively.

7. The heat pipe as recited in claim 1, wherein the wick structure includes at least a support portion pressing an inner wall of the flat tube.

8. The heat pipe as recited in claim 1, wherein the wick structure is disconnected to the front and rear sealed ends of the flat tube in the axial direction.

9. The heat pipe as recited in claim 1, wherein the middle section does not contact an upper wall of the flat tube.

* * * * *